United States Patent [19]

Knuppertz et al.

[11] 4,323,029

[45] Apr. 6, 1982

[54] LABELING MACHINE, ESPECIALLY FOR BOTTLES HAVING A FOUR-WAY TOGGLE MECHANISM AS A DRIVE

[75] Inventors: Heinz W. Knuppertz, Dusseldorf; Hans Lederer, Meerbusch, both of Fed. Rep. of Germany

[73] Assignee: Jagenberg Werke AG, Dusseldorf, Fed. Rep. of Germany

[21] Appl. No.: 38,374

[22] Filed: May 11, 1979

[30] Foreign Application Priority Data

May 19, 1978 [DE] Fed. Rep. of Germany ..... 2821895

[51] Int. Cl.[3] ..... B05C 1/02; B65C 9/16

[52] U.S. Cl. ..... 118/231; 118/236; 118/240; 118/244; 156/568; 156/571; 271/33

[58] Field of Search ..... 118/231, 220, 236, 240, 118/244; 271/33, 38, 95, 115, 264; 156/567, 568, 571

[56] References Cited

U.S. PATENT DOCUMENTS 4,077,621 3/1978 Knuppertz et al. ..... 118/231 X

*Primary Examiner*—John P. McIntosh

*Attorney, Agent, or Firm*—Sprung, Felfe, Horn, Lynch & Kramer

[57] ABSTRACT

In a labeling machine having a rotatable carrier and at least one pickup element rotatably mounted on the carrier, the drive for each pickup element comprising a four-way toggle mechanism including a crank, a connecting rod, a swinging link, with the connecting rod being joined to the crank and swinging link at two respective joints. Two cam followers are connected to the connecting rod by lever arms and are disposed outside the joints of the swinging link and the connecting rod on the one hand and the connecting rod and crank on the other hand. The four-way toggle mechanism and lever arms fixed to the connecting rod of the followers are adjusted to one another such that during a revolution of the carrier, the field swept by the swinging link does not encompass the axis of rotation of the carrier.

1 Claim, 4 Drawing Figures

LABELING MACHINE, ESPECIALLY FOR BOTTLES HAVING A FOUR-WAY TOGGLE MECHANISM AS A DRIVE

BACKGROUND OF THE INVENTION

The invention relates to a labeling machine for objects, especially bottles, with several stations consecutively arranged along a path, namely, a gluing station, a label-supply station and a label-transfer station as well as at least one pickup element for the labels which is rotatably mounted on a revolving carrier and with each revolution of the carrier is moved past the stations, each such pickup element having an outwardly curved label receiving surface which rolls along the label which is foremost in each case, and along the other stations. With each pickup element is associated as a drive, a four-way toggle mechanism comprising a crank, a connecting rod and a swinging link. Two cam followers engaging the connecting rod are provided which are spaced a fixed distance apart and each of which is guided in a curved track cam path of its own which imparts to the pickup element a rotary motion with constant direction of rotation, the rotary motion being controlled by one of the followers when the other follower is in a dead position.

A labeling machine of this type is known from U.S. Pat. No. 4,077,621, particularly FIG. 8. In that labeling machine, the cam followers of the four-way toggle mechanism are disposed in such a way at the joints between the crank and the connecting rod on the one hand and connecting rod and swinging link on the other hand that the distance of one of the followers from the axis of rotation of the crank (of the pickup element) and the distance of the other follower from the axis of rotation of the swinging link are constant.

A complete revolution of the crank, and with it a complete rotation of the pickup element without reversal of direction, is achieved with the four-way toggle mechanism in that one of the curved track cam paths intersects the other curved track cam path or, respectively, that one of the curved track cam paths is formed only of curve segments. This means that one of the followers is only partly guided by the curved track cam path associated with it. The departure of that follower from the curved track cam path and its reintroduction into the curved track cam path is a drawback from the control standpoint since it entails increased wear. It would be preferable if the second follower, too, could constantly remain in its curved track cam path and the force necessary for the drive could be divided between the two followers.

SUMMARY OF THE INVENTION

The invention has as its object to provide a labeling machine of the type mentioned above in which during a complete revolution of the carrier the cam followers remain in engagement in closed, nonintersecting curved track cam paths lying in the same plane, the forces to be produced by the followers for the complete rotation of the pickup element being distributed between the two followers as optimally as possible.

In accordance with the invention, this object is accomplished in that the followers are disposed outside the joints of the swinging link and connecting rod on the one hand and the connecting rod and crank on the other hand, and that the four-way toggle mechanism and the connecting rod mounted lever arms of the followers are adjusted to one another in such a way that the field which during the rotation of the carrier is swept by an area that is in register with the swinging link and is located outside the center of rotation of the carrier.

The drive in accordance with the invention makes it possible to obtain by simple means, not only a drive for the pickup elements but also an accelerated and retarded rotary motion required for rolling along the station surfaces without reversal of the direction of rotation and with a favorable course of the curved track cam paths i.e. (no intersecting of the two closed curved track cam paths) in the same plane. Arranging the curved track cam paths in the same plane is desirable in order that the cam followers, in particular rollers, may engage the lever arms at the four-way toggle mechanism with lever arms in the form of roller pins that are as short as possible. Since the cam followers are disposed outside the joints of the swinging link and connecting rod on the one hand and connecting rod and crank on the other hand, optimization of the forces for the rotary motion of the pickup elements to be distributed between the two cam followers may be secured with a nonintersecting path of the curved track cam paths. When it is borne in mind that with the output required today of a labeling machine, a carrier fitted with three pickup elements executes 300 revolutions per minute, it is readily appreciated that the wear to which the roller which enters and leaves a curved track cam path three times per revolution is subject is excessively high. This is why it has hitherto not been possible in practice to employ labeling machines based on the described known principle of the four-way toggle joint for such high output rates. For labeling machines with rotating pickup elements designed for such high output rates, epicyclic gearing with differential gears are used. However, such drives are considerably more expensive and complex than the drive in accordance with the invention.

The invention will now be described in greater detail with reference to accompanying drawings, wherein:

BRIEF DESCRIPTION OF THE INVENTION

DETAILED DESCRIPTION OF THE INVENTION

Figure 1:
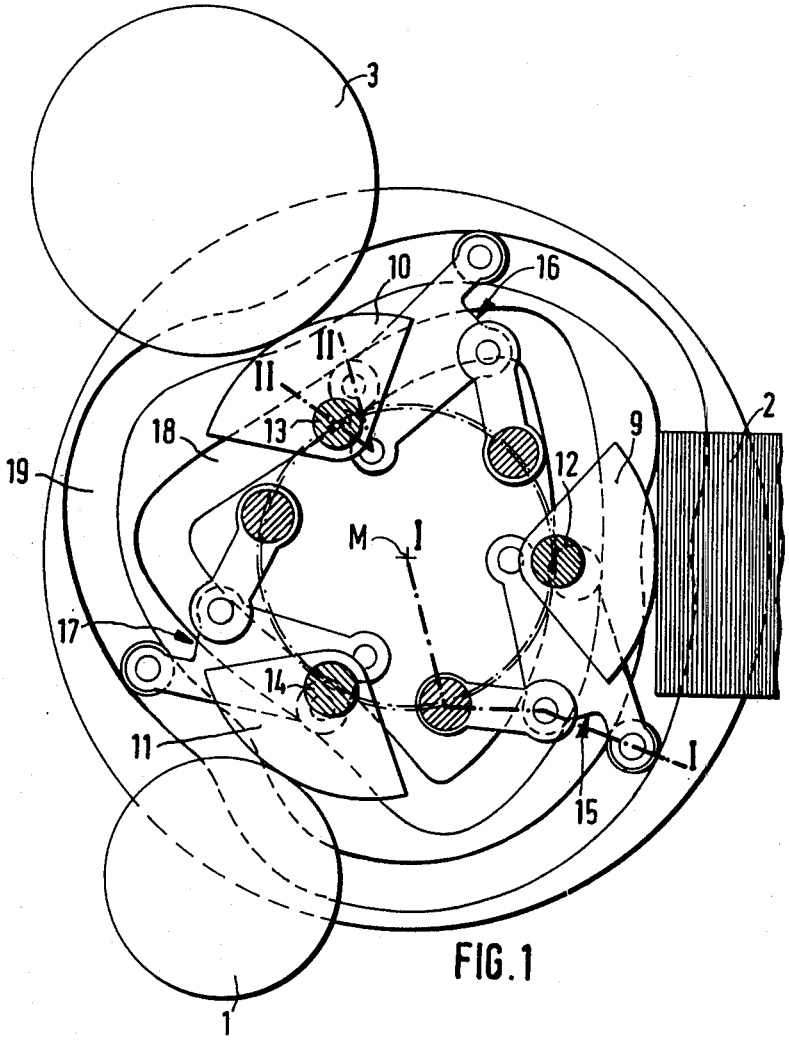
FIG. 1 is a diagrammatic top plan view of a labeling station of a labeling machine according to the invention.
Figure 2:
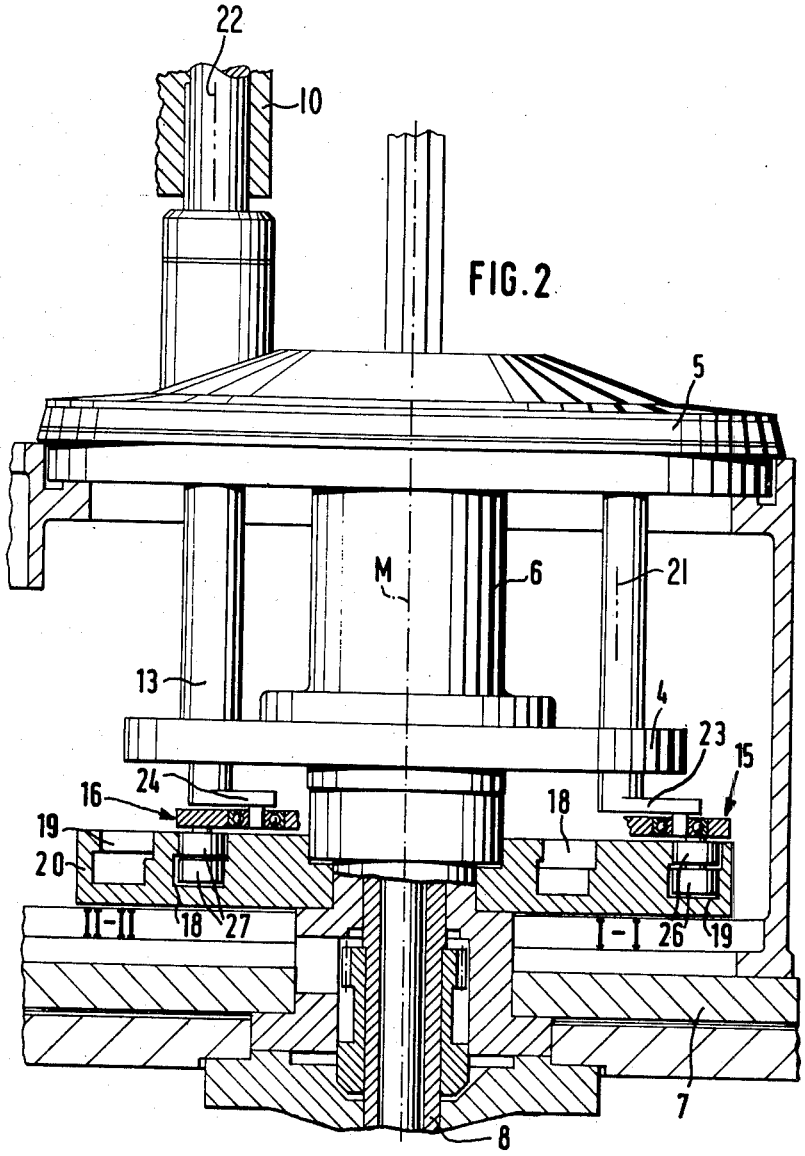
FIG. 2 is an axial section through the labeling station of FIG. 1, taken along the lines I—I and II—II in FIG. 1.

The labeling station shown in FIGS. 1 and 2 is disposed midway between a glue roll 1, a label stack 2 and a gripper cylinder 3. The labeling station comprises a carrier having a lower circular plate 4 and an upper circular plate 5 and a middle section 6 connecting the two plates 4 and 5. The carrier including elements 4–6 is rotatably mounted in a frame 7 and driven through a hollow drive shaft 8. Rotatably and eccentrically mounted on the carrier are three identical pickup elements 9, 10 and 11. Each pickup element has a cylindrically curved receiving surface and is mounted on a drive shaft 12, 13 and 14 located between the center of its curvature and the receiving surface and driven by its own drive 15, 16 and 17. These drives 15, 16 and 17 are guided in stationary, closed, nonintersecting curved track cam paths 18 and 19 in a disk cam 20 which is non-rotatably mounted in the frame 7.

Figure 3:
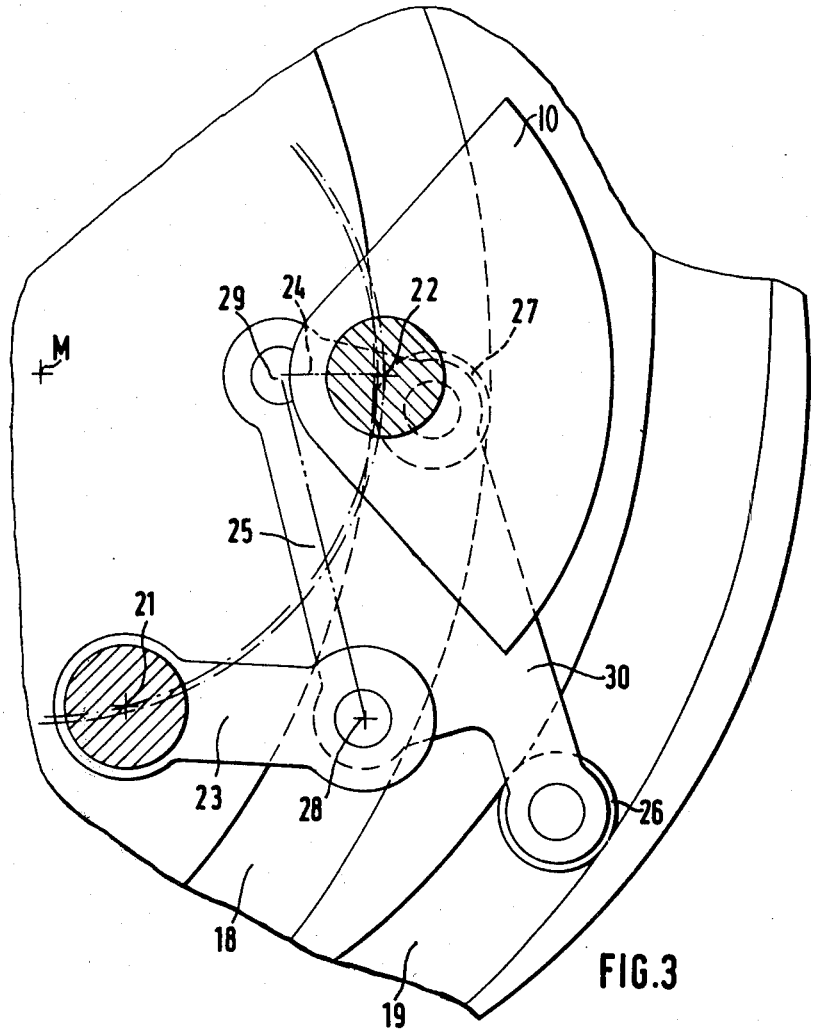
FIG. 3 is a top plan view of a pickup element with drive on an enlarged scale with respect to FIG. 1.

The special characteristics of the invention will now be described in terms of the drive 15 which is shown enlarged in FIG. 3. Each drive comprises a four-way toggle mechanism with a first fixed point 21 and a second fixed point 22 with respect to the carrier as well as a swinging link 23 rotatable about the fixed point 21 and a crank represented by the dash-dot line 24 rotatable about the fixed point 22. The mechanism also includes a connecting rod represented by the dash-dot line 25 articulated to the free ends of the swinging link 23 and the crank 24. Rigidly joined to the connecting rod 25 by means of lever arms which are integral portions of plate 30 are two rollers 26 and 27, each of which is guided in one of the curved track cam paths 18 and 19 as a cam follower. In contrast to the known state of the art, the rollers 26 and 27 are not mounted at the joints 28 and 29 between the swinging link 23 and the connecting rod 25 on the one hand and the connecting rod 25 and the crank 24 on the other hand but outside those joints. This arrangement of the rollers 26 and 27 and their rigid connection to the connecting rod 25 is realized through a common plate 30.

Figure 4:
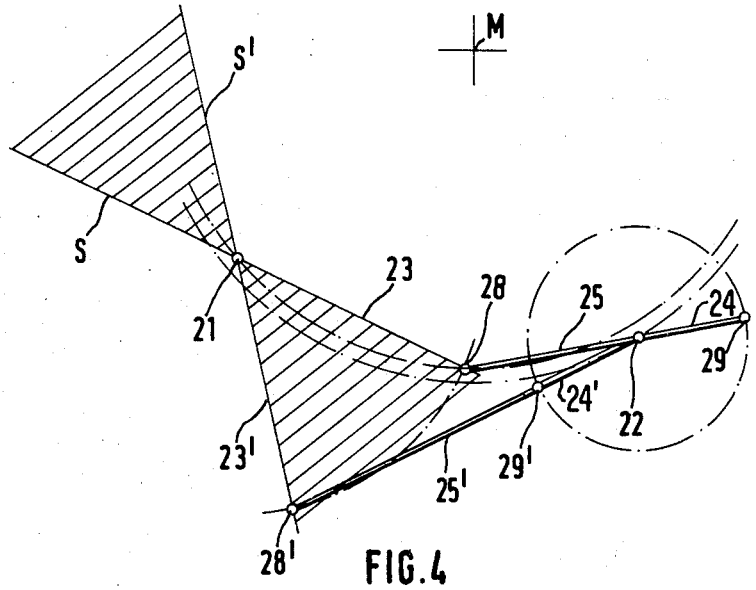
FIG. 4 is a diagrammatic top plan view of the motions of the four-way toggle mechanism between its two extreme positions.

In FIG. 4, the swinging link 23 and the connecting rod 25 are shown superimposed on top of each other for two successive extreme positions, the reference symbols of the parts for the second position being primed for identification. It is apparent from this diagram that the center M of the carrier is located outside the shaded cross-hatched field which is swept by the area between S, S' that is in register with the swinging link 23.

Through the joint use of the two measures described, namely, locating the points engagement of the cam followers 26 and 27 away from the joints 28 and 29, and selecting the articulated lever arms in such a way that the field swept by the swinging link is located outside the center M of the carrier, closed curved track cam paths for the control of the four-way toggle mechanism, which do not intersect in the same plane, can be obtained.

It will be appreciated that the instant specification and example are set forth by way of illustration and not limitation, and that various modifications and changes may be made without departing from the spirit and scope of the present invention.

What is claimed is:

1. In a labeling machine for objects having a gluing station, a label-supply station and a label-transfer station consecutively arranged along a path, a rotatable carrier, at least one pickup element rotatably mounted on the carrier such that with each revolution of the carrier it is moved past the stations, each pickup element having an outwardly curved label receiving surface which rolls along the foremost label and along the other stations and a drive for each pickup element comprising a four-way toggle mechanism including a crank, a connecting rod and a swinging link, the connecting rod being joined to the crank and swinging link at two respective joints, two cam followers connected to the connecting rod by lever arms and which are spaced a fixed distance apart, a curved track cam path for each cam follower to impart to the pickup element a rotary motion with constant direction of rotation the rotary motion being controlled by one of the followers when the other follower is in a dead position, the improvement wherein the cam followers are disposed outside the joints of the swinging link and connecting rod on the one hand and the connecting rod and crank on the other hand, and the four-way toggle mechanism and the lever arms fixed to the connecting rod of the followers are adjusted to one another such that during a revolution of the carrier the field swept by the swinging link does not encompass the axis of rotation of the carrier.

* * * * *